US010454161B1

(12) United States Patent
Puzella et al.

(10) Patent No.: US 10,454,161 B1
(45) Date of Patent: Oct. 22, 2019

(54) RADOME ASSEMBLY

(71) Applicant: Raytheon Company, Waltham, MA (US)

(72) Inventors: Angelo M. Puzella, Marlborough, MA (US); John Sangiolo, Auburndale, MA (US); Mark Ackerman, Douglas, MA (US); Dennis W. Mercier, Hudson, MA (US); Jeffrey Paquette, Sudbury, MA (US)

(73) Assignee: RAYTHEON COMPANY, Waltham, MA (US)

( * ) Notice: Subject to any disclaimer, the term of this patent is extended or adjusted under 35 U.S.C. 154(b) by 460 days.

(21) Appl. No.: 15/061,170

(22) Filed: Mar. 4, 2016

(51) Int. Cl.
*H01Q 1/42* (2006.01)

(52) U.S. Cl.
CPC ..... *H01Q 1/42* (2013.01)

(58) Field of Classification Search
CPC ..... H01Q 1/42; H01Q 1/427; H01Q 1/405; H01Q 1/421; H01Q 1/428
See application file for complete search history.

(56) References Cited

U.S. PATENT DOCUMENTS

| | | | | |
|---|---|---|---|---|
| 2,959,785 | A | 11/1960 | Leatherman et al. | |
| 4,914,449 | A | 4/1990 | Fukuzawa et al. | |
| 5,355,142 | A | 10/1994 | Marshall et al. | |
| 5,392,056 | A | 2/1995 | Deteso | |
| 5,907,304 | A | 5/1999 | Wilson et al. | |
| 7,560,400 | B2 | 7/2009 | Fredberg et al. | |
| 9,123,998 | B1 * | 9/2015 | LoRe | H01Q 1/424 |
| 2005/0014430 | A1 * | 1/2005 | Fredberg | B32B 27/12 442/59 |
| 2005/0068247 | A1 * | 3/2005 | Yoneya | H01Q 1/088 343/872 |
| 2005/0229446 | A1 | 10/2005 | Bagley | |
| 2006/0071873 | A1 * | 4/2006 | Warnagiris | H01Q 1/362 343/895 |
| 2012/0274533 | A1 | 11/2012 | Bouguereau et al. | |
| 2013/0255166 | A1 | 10/2013 | Johansson | |

FOREIGN PATENT DOCUMENTS

WO 2009131219 A1 10/2009

OTHER PUBLICATIONS

ISR/WO, Issued May 30, 2017, RAY0329PCT, PCT Application No. PCT/US2017/020368, 11 pages.

* cited by examiner

*Primary Examiner* — Jessica Han
*Assistant Examiner* — Awat M Salih
(74) *Attorney, Agent, or Firm* — Cantor Colburn LLP

(57) ABSTRACT

A low profile, low loss, wide band, wide scan volume radome assembly is provided for an antenna. The radome assembly includes a fabric radome element disposable over the antenna, first radome securing elements securably embedded within the fabric radome element and second radome securing elements securably embedded within the antenna. The second radome securing elements are respectively engageable with the first radome securing elements to thereby secure the fabric radome element over the antenna.

10 Claims, 7 Drawing Sheets

RADOME ASSEMBLY

BACKGROUND

The present invention relates to radomes and, more specifically, to radome assemblies.

A radome is a structural, weatherproof enclosure that protects a radar system or antenna surface from weather and foreign object impacts. Ideally, a radome for a given radar system or antenna minimally attenuates electromagnetic signals transmitted from or received by the radar system or the antenna.

Presently, most radomes for military applications are large, thick, heavy and costly structural features. Thus, non-structural radomes (a non-structural radome is defined as a radome that is not load bearing), which are constructed of material that minimally attenuates transmitted or received electromagnetic signals, have been developed for small and large area antenna apertures. While such development has led to relatively light-weight non-structural radomes that exhibit good performance characteristics with one or more of reduced profiles, reduced transportation costs and reduced issues with thermal expansion and contraction, the relatively light-weight non-structural radomes present additional problems not typically encountered with structural radomes.

For example, a light-weight non-structural radome for a large area antenna aperture may be difficult to secure in place under high wind loads. That is, the light-weight non-structural radome could be very tightly pinned to an antenna housing but only at the risk of tearing the radome material and making the light-weight non-structural radome not easily removable for antenna maintenance. On the other hand, the light-weight non-structural radome could be loosely tied down, but at the risk of blowing away at the first wind gusts it encounters.

SUMMARY

According to one embodiment of the present invention, a low profile, low loss, wide band, wide scan volume radome assembly is provided for an antenna. The radome assembly includes a fabric radome element disposable over the antenna, first radome securing elements securably embedded within the fabric radome element and second radome securing elements securably embedded within the antenna. The second radome securing elements are respectively engageable with the first radome securing elements to thereby secure the fabric radome element over the antenna.

According to another embodiment, a radome apparatus is provided and includes a housing, an antenna supportively disposable within the housing and a low profile, low loss, wide band, wide scan volume radome. The low profile, low loss, wide band, wide scan volume radome includes a fabric radome element disposable in a single layer over an entire outermost portion of the antenna, first radome securing elements securably embedded within the fabric radome element and second radome securing elements securably embedded within the antenna. The second radome securing elements are respectively engageable with the first radome securing elements to thereby secure the fabric radome element over the entire outermost portion of the antenna in the single layer.

According to another embodiment, a method of radome provision for an antenna is provided and includes securably embedding first radome securing elements within a fabric radome element, securably embedding second radome securing elements within the antenna and disposing the fabric radome element over the antenna such that the first and second radome securing elements respectively engage to thereby secure the fabric radome element over the antenna.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

As will be described below, a radio frequency (RF) radome is provided along with a method for placing or rolling the RF radome onto a planar antenna surface (e.g., a planar phased array antenna surface) without the need for pins or other mechanical attachment features that would pierce the radome material in order to secure it. The RF radome is formed of compliant fabric material and may have first securing elements periodically embedded therein. The compliant fabric material can be placed on or rolled across and onto an antenna surface, in which second securing elements are embedded, and then fastened down to the antenna surface with the first and second securing elements respectively engaging. Such engagement may result in a minimal air-gap between the radome material and the antenna surface at the engagement locations.

Figure 1A:
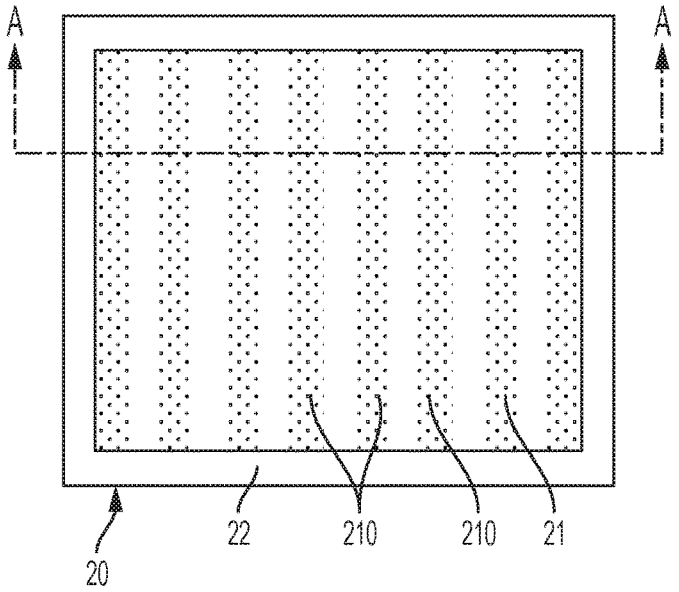
FIG. 1A is a top-down illustration of a planar phased array antenna in accordance with embodiments.
Figure 1B:
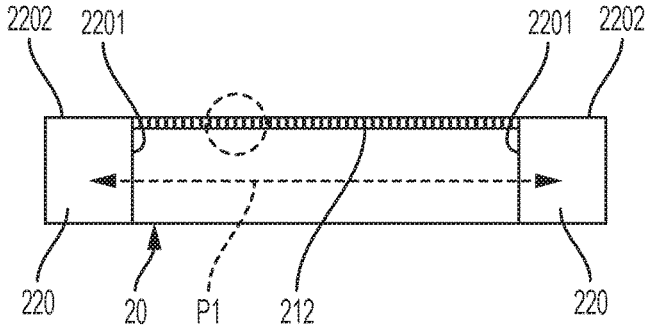
FIG. 1B is a side view of the planar phased array antenna of FIG. 1A taken along line A-A.
Figure 2:
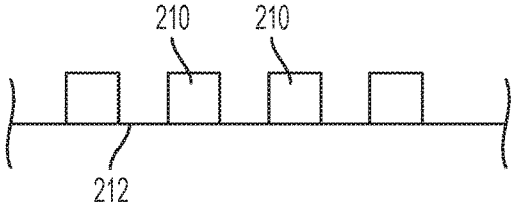
FIG. 2 is an enlarged view of components of the planar phased array antenna of FIGS. 1A and 1B within the encircled portion of FIG. 1B.
Figure 3:
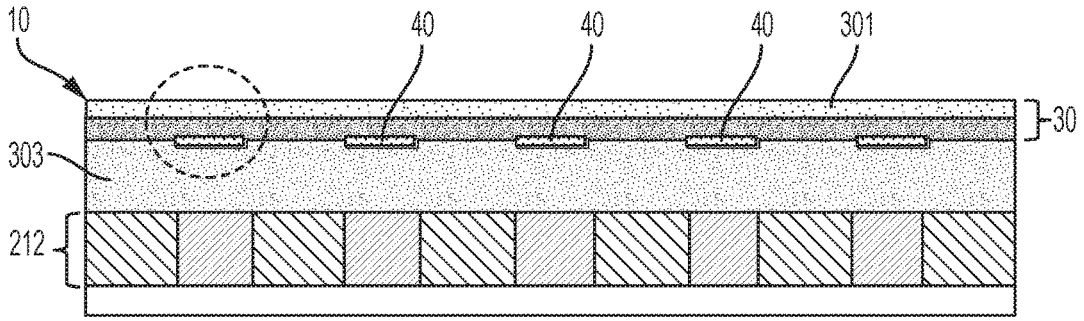
FIG. 3 is a side view of a radome assembly for use with the planar phased array antenna of FIGS. 1A, 1B and 2 in accordance with embodiments.

With reference to FIGS. 1A and 1B and, with additional reference to FIGS. 2 and 3, a low profile, low loss, wide band, wide scan volume radome assembly 10 (see FIG. 3) is provided for use with, for example, an antenna or more specifically a planar phased array antenna 20. While, it is to be understood that the radome assembly 10 could be provided for any type of antenna, the following disclosure with relate to the case where the radome assembly 10 is provided for use with the planar phased array antenna 20 for purposes of clarity and brevity.

The planar phased array antenna 20 includes a radiator portion 21 and a housing 22. The radiator portion 21 includes a plurality of radiators/antennae 210 that are responsible for the transmission/reception of EM radiation by the radiator portion 21. The plurality of radiators/antennae 210 may be arranged as ribs in an egg-crate configuration in an outermost portion 212 (see FIG. 1B) that extends along a plane P1 (see FIG. 1B). The radiator portion 21 and the housing 22 may both having similar polygonal or annular shapes, including, but not limited to a square as shown in FIG. 1A. In any case, the housing 22 includes wall portions 220 with interior facing surfaces 2201 and forward facing surfaces 2202 (see FIG. 1B). The peripheral portions of the radiator portion 21 are attached to the interior facing surfaces 2201 such that the radiator portion 21 may be supportively disposed within the housing 22 to extend along the plane P1. The forward facing surfaces 2202 face forwardly in a direction normal to the plane P1.

As shown in FIG. 3, the low profile, low loss, wide band, wide scan volume radome assembly 10 includes a fabric radome element 30, which is disposable over the planar phased array antenna 20, first radome securing elements 40 that are embedded within the fabric radome element 30 and second radome securing elements 50 that are embedded within the planar phased array antenna 20. The fabric radome element 30 is formed of thin fabric material and can be rolled up for storage or transportation and rolled out or placed over the planar phased array antenna 20. In accordance with embodiments, the thin fabric material may include Teflon®-fiberglass composite materials. However, as a general matter, it is to be understood that the thin fabric material may have low dielectric constant and low loss tangent characteristics, be hydrophobic with a hydrophobic contact angle of greater than 90 degrees, non-absorptive of water (e.g., less than 0.5% of water by weight), be resistant to icing and tearing, have a high tensile strength and shear modulus and be essentially chemically inert, non-flammable and relatively maintenance free.

With continued reference to FIG. 3 and with additional reference to FIGS. 4-7, the fabric radome element 30 may include a substrate layer 301 and an outermost layer 302 that lies atop the substrate layer 301 (in FIG. 3, the outermost layer 302 faces downwardly toward the planar phased array antenna 20). At least the outermost layer 302 may be provided as a weave 3020 (see FIG. 5) of the thin fabric material. The substrate layer 301 may be provided in any woven or non-woven form of the thin fabric material. The first radome securing elements 40 are securably embedded within the fabric radome element 30 and, in accordance with embodiments, may be securably embedded within or otherwise adhered or coupled to the outermost layer 302 of the first fabric radome element 30. The second radome securing elements 50 are securably embedded within the planar phased array antenna 20 and, in accordance with embodiments, may be securably embedded within counter bore holes 213 defined in the outermost portion 212 of the radiator portion 21.

Figure 6:
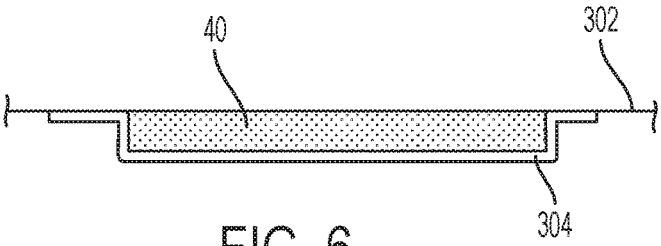
FIG. 6 is a side view of a fabric radome securing element being secured to a fabric radome by a patch.
Figure 7:
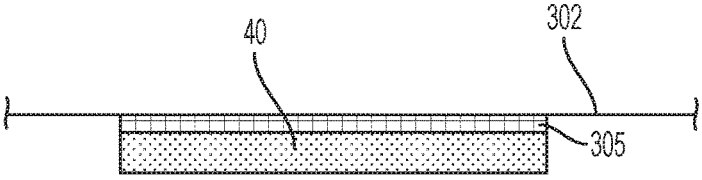
FIG. 7 is a side view of a fabric radome securing element being secured to a fabric radome by adhesive.

In accordance with alternative embodiments, the first radome securing elements 40 may be adhered to the outermost layer 302 by a patch 304 (see FIG. 6) or by adhesive 305 (see FIG. 7). As shown in FIG. 6, each individual patch 304 tightly fits over a corresponding one of the first radome securing elements 40 and a proximal portion of the outermost layer 302 to securely attach the one of the first radome securing elements 40 to the outermost layer 302 without affecting the engagement of the one of the first radome securing elements 40 with the corresponding one of the second radome securing elements 50. As shown in FIG. 7, the adhesive 305 may be interposed between the outermost layer 302 and each of the first radome securing elements 40.

Regardless of how the first radome securing elements 40 are embedded within or otherwise adhered to the outermost layer 302 of the fabric radome element 30, the fabric radome element 30 is formed to be unitary and continuous. That is, the fabric radome element 30 is not pierced or cut in any way, shape or form in order for the first fabric radome elements 40 to be embedded within or adhered to the outermost layer 302. Thus, in accordance with alternative embodiments and with reference to FIG. 5, where the outermost layer 302 is provided as the weave of the thin fabric material and the first radome securing elements 40 are embedded within the outermost layer 302, the first radome securing elements 40 may be interposed within interstitial regions 3021 defined by the weave 3020.

In any case, the first radome securing elements 40 may be disposed in a first periodic pattern. Similarly, where the plurality of radiators/antennae 210 are arranged as the ribs in the egg-crate configuration within the outermost portion 212, the second radome securing elements 50 may be securably embedded within the ribs in a second periodic pattern. The first and second periodic patterns may be configured such that the first and second radome securing elements 40 and 50 respectively correspond to each other in terms of location and, in some but not all cases, size.

With such location (and size) correspondence, the first and second radome securing elements 40 and 50 are configured to be respectively engageable with each other to thereby secure the fabric radome element 30 over at least the radiator portion 21 of the planar phased array antenna 20. Such engagement is provided to center the fabric radome element 30 over the radiator portion 21 as the location correspondence between the first and second radome securing elements 40 and 50 serve to position the fabric radome element 30 over the radiator portion 21. The engagement is further provided such that the respective, individual engagements combine to hold the fabric radome element 30 in place relative to the radiator portion 21 even in cases of high wind and/or transportation while permitting an operator to progressively remove disengage the first and second radome securing elements 40 and 50 in order to permit at least some degree of access to the radiator portion 21.

Each respective, individual engagement (i.e., of one first radome securing element 40 and a corresponding one second radome securing element 50) is provided to be selectively disengaged by an operator. Thus, where the fabric radome element 30 is disposed over the radiator portion 21, some part of the fabric radome element 30 can be progressively pulled away from the radiator portion 21 by the operator such that the resultant exposed section of the radiator portion 21 is accessible. In accordance with embodiments, multiple engagements (i.e., of some, but not all of the first radome securing elements 40 and corresponding ones of the second radome securing elements 50) can be selectively disengaged at once by the operator. Thus, if the operator pulls on a corner of the fabric radome element 30 all of the engagements at or near the corner being pulled may be progressively disengaged at a same time without the need for excessive pull force being exerted by the operator.

Figure 4:
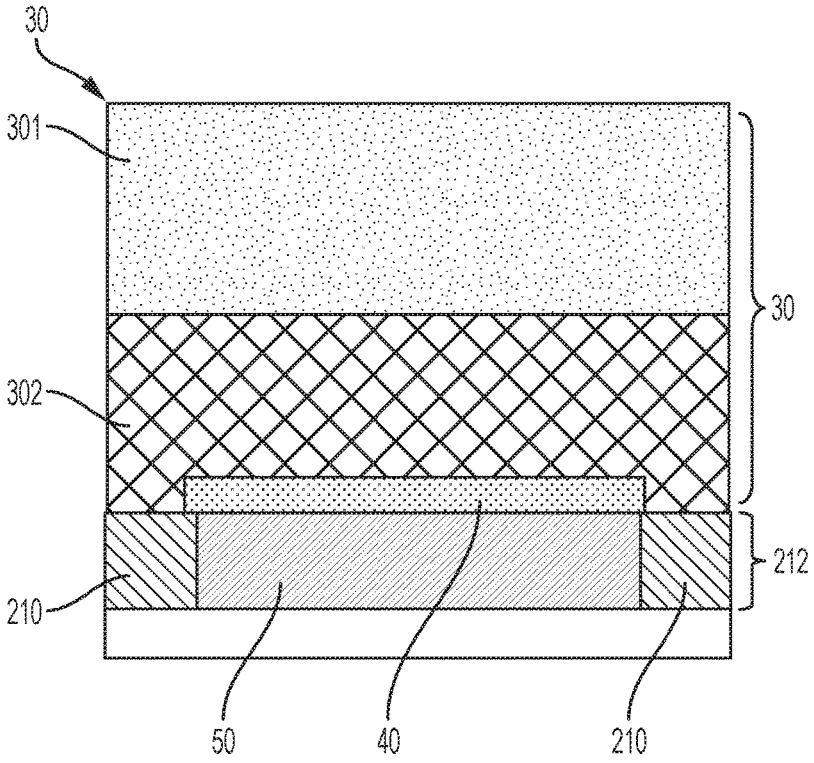
FIG. 4 is a side view of a radome assembly for use with the planar phased array antenna of FIGS. 1A, 1B and 2 in accordance alternative embodiments.
Figure 5:
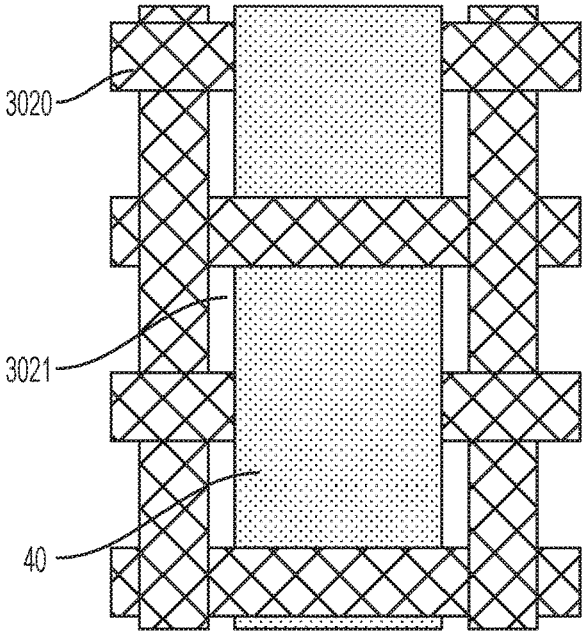
FIG. 5 is a schematic illustration of a fabric radome securing element secured within an interstitial region of a weave.

With continued reference to FIGS. 3 and 4, the engagement of the first and second radome securing elements 40 and 50 will cause the fabric radome element 30 to become attached to the radiator portion 21 of the planar phased array antenna 20 with a zero air gap. This zero air gap may be achieved with or without a foam spacer 303 to be described below. In some cases, as shown in FIG. 4, this attachment will result in the outermost layer 302 of the fabric radome element 30 abutting directly with the outermost portion 212 of the radiator portion 21. However, in a case where the fabric radome element 30 is desired to be separated from but still attached to the radiator portion, the low profile, low loss, wide band, wide scan volume radome assembly 10 may include a foam spacer 303 as shown in FIG. 3.

As a component of the low profile, low loss, wide band, wide scan volume radome assembly 10, the foam spacer 303 is interposable between the outermost portion 212 of the radiator portion 21 of the planar phased array antenna 20 and the outermost layer 302 of the fabric radome element 30. As such, the foam spacer 303 may also be interposable between the first radome securing elements 40 and each of the corresponding second radome securing elements 50. Thus, in the cases where the foam spacer 303 is provided, the respective engagements between the first and second radome securing elements 40 and 50 need to be configured to act at a distance, which is equivalent to or greater than the thickness of the foam spacer 303.

In accordance with alternative embodiments, the foam spacer 303 may be secured to the fabric radome element 30 and the first radome securing elements 40 may be disposed at an outermost layer of the foam spacer 303. In such cases, the first and second radome securing elements 40 and 50 could be flush with one another and the foam spacer 30 could still be interposed between the antenna 20 and the fabric radome element 30.

Figure 8:
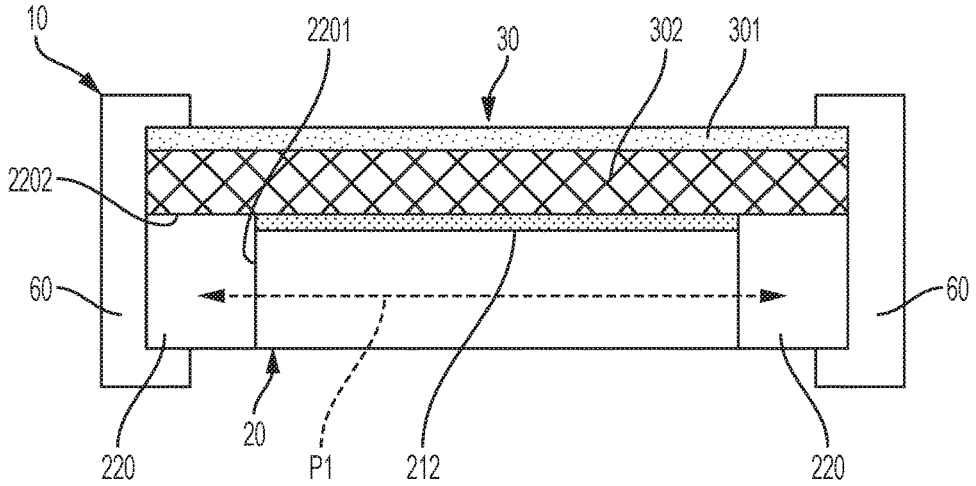
FIG. 8 is a side view of a radome assembly with peripheral fasteners in accordance with embodiments.

In accordance with embodiments and, with reference to FIG. 8, the low profile, low loss, wide band, wide scan volume radome assembly 10 may further include peripheral fasteners 60. The peripheral fasteners 60 may be disposed to secure a periphery of the fabric radome element 30 to a periphery of the planar phased array antenna 20. More particularly, the peripheral fasteners 60 may be provided as clamps or other mechanical fasteners, such as cords, adhesives and preloaded housing flanges, which secure the periphery of the fabric radome element 30 to the forward facing surfaces 2202 of the wall portions 220 of the housing 22 without piercing the fabric radome element 30. Where the peripheral fasteners 60 are provided as clamps, the clamps may be configured as C-shaped clamps with flat, planarized grippers. In any case, the peripheral fasteners 60 serve to prevent the fabric radome element 30 from falling away from the housing 22 irrespective of a condition of the engagement status of the first and second radome securing elements 40 and 50.

Figure 9:
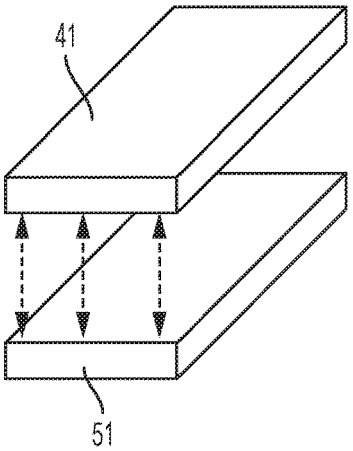
FIG. 9 is a schematic illustration of a pair of first and second radome securing elements in accordance with magnetic embodiments.
Figure 10:
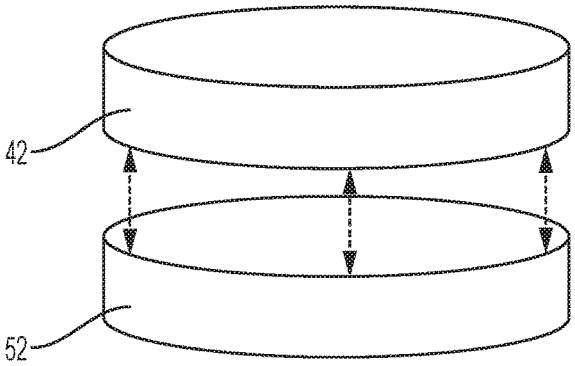
FIG. 10 is a schematic illustration of a pair of first and second radome securing elements in accordance with alternative magnetic embodiments.

With reference to FIGS. 9 and 10, the first and second radome securing elements 40 and 50 may be magnetically attracted to one another but do not measurably affect antenna RF performance over effective frequency and/or array scan volume ranges. In an exemplary case, the first radome securing elements 40 may include one of metallic or magnetic members, such as strips 41 (see FIG. 9) or disks 42 (see FIG. 10), and the second radome securing elements 50 may include the other one of the metallic or magnetic members, such as strips 51 (see FIG. 9) or disks 52 (see FIG. 10). In either case, the magnetic members may include, for example, commercially available, high energy product rare earth magnets like Neodymium or Samarium-Cobalt, which have a high resistance to demagnetization and will not lose their magnetization around other magnets or if dropped. In accordance with embodiments, the magnetic members may be provided as nickel-copper-nickel or nickel-copper-nickel-gold plated Neodymium magnets.

In accordance with alternative embodiments, the magnetic members may be formed of other materials, such as ferromagnetic materials. In accordance with still other alternatives, the magnetic members may be provided as electromagnets that are activated by an application of current thereto such that the magnetic attraction between the first and second radome securing elements 40 and 50 can be selectively turned on and off.

Figure 11:
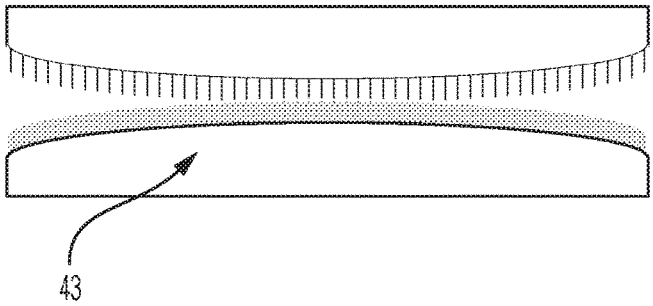
FIG. 11 is a schematic illustration of a pair of first and second radome securing elements in accordance with mechanical embodiments.
Figure 12:
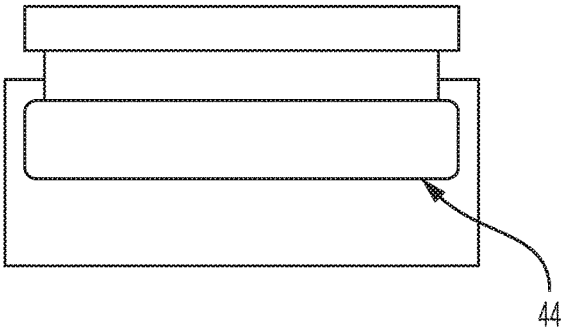
FIG. 12 is a schematic illustration of a pair of first and second radome securing elements in accordance with alternative mechanical embodiments.

With reference to FIGS. 11 and 12, the first and second radome securing elements 40 and 50 may be mechanically fastened to one another. In exemplary cases, the first and second radome securing elements 40 and 50 may be provided as Velcro™ patches 43 (see FIG. 11) or as mechanical interference devices 44 such as buttons or clips (see FIG. 12).

Figure 13:
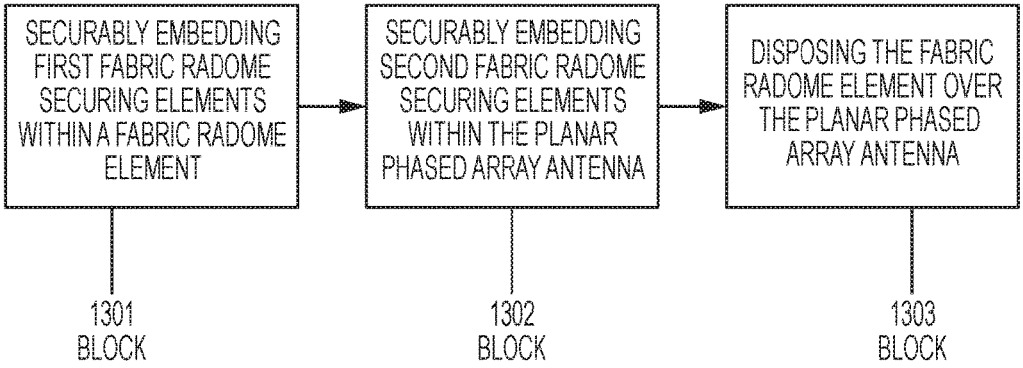
FIG. 13 is a flow diagram illustrating a method of radome provision for a planar phased array antenna in accordance with embodiments.

In accordance with further aspects, a method of radome provision is provided for a planar phased array antenna, such as the planar phased array antenna 20 described above. With reference to FIG. 13, the method includes securably embedding first radome securing elements within a fabric radome element (block 1301), securably embedding second radome securing elements within the planar phased array antenna (block 1302) and disposing the radome element over the planar phased array antenna (block 1303) such that the first and second radome securing elements respectively engage to thereby secure the fabric radome element over the planar phased array antenna.

In accordance with embodiments, the method may further include securably disposing the planar phased array antenna within a housing and securing a periphery of the fabric radome element to the housing. In addition, once the fabric radome element is securely disposed over the planar phased array antenna, the method may further include selectively pulling at least a portion of the fabric radome element away from the planar phased array antenna to respectively disengage at least a portion of the first and second radome securing elements so as to permit maintenance and/or operator access to the planar phased array antenna.

Figure 14A:
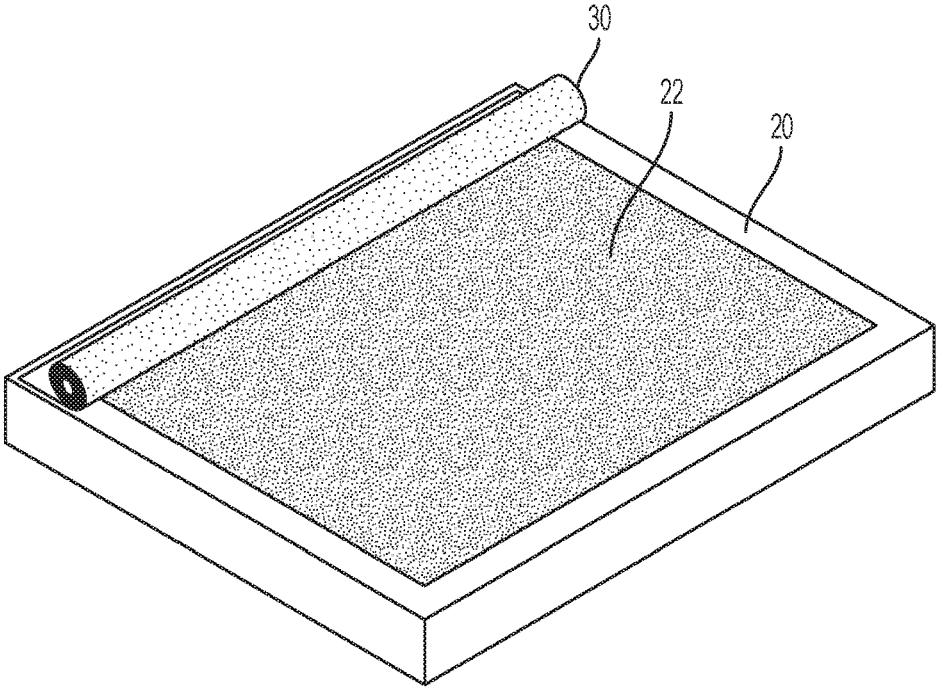
FIG. 14A is an illustration of an initial rolling-out stage of a fabric radome element over a planar phased array antenna in accordance with embodiments.
Figure 14B:
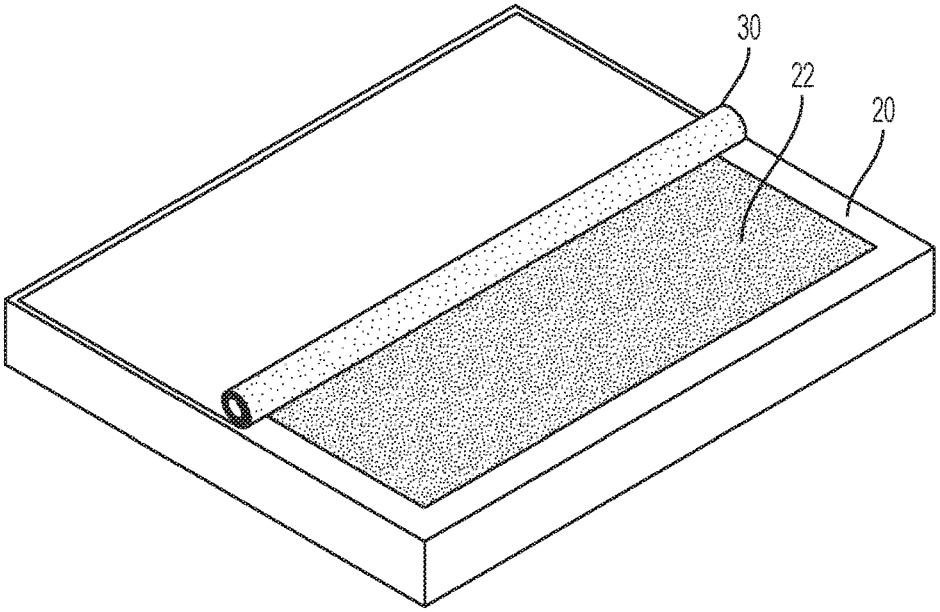
FIG. 14B is an illustration of an intermediate rolling-out stage of a fabric radome element over a planar phased array antenna in accordance with embodiments.
Figure 14C:
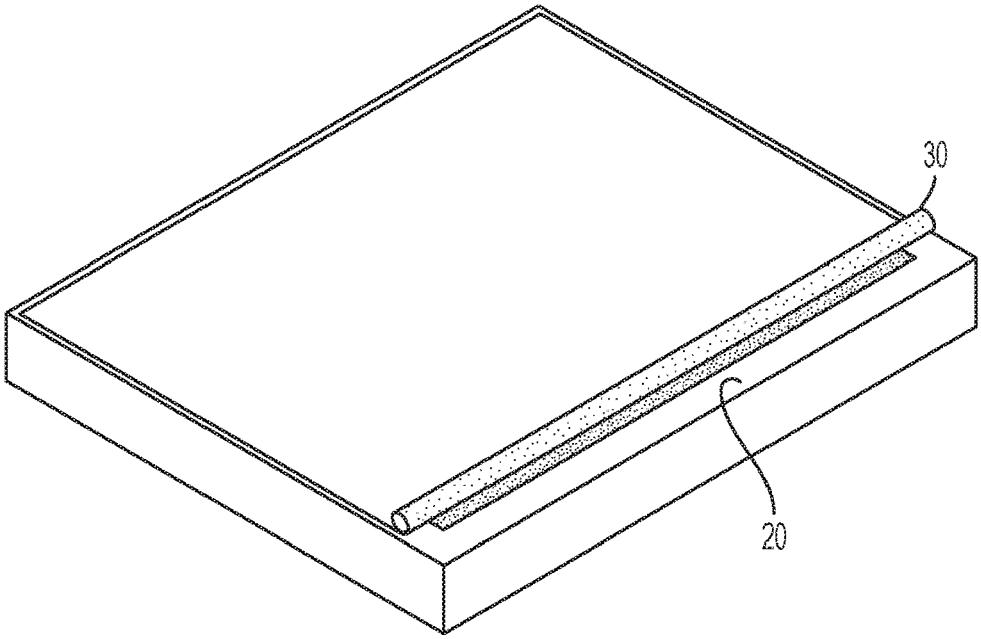
FIG. 14C is an illustration of an intermediate rolling-out stage of a fabric radome element over a planar phased array antenna in accordance with embodiments.
Figure 14D:
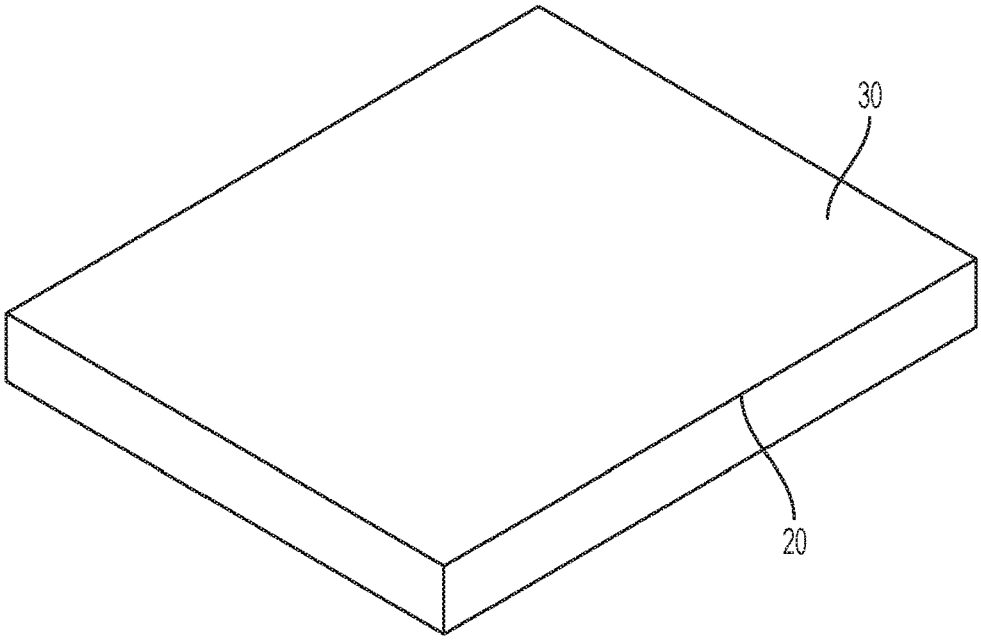
FIG. 14D is an illustration of a late rolling-out stage of a fabric radome element over a planar phased array antenna in accordance with embodiments.

In accordance with embodiments and, with reference to FIGS. 14A-14D, the disposing of the fabric radome antenna may include at least one or both of normal placement of the fabric radome element over the planar phased array antenna and a rolling out of the fabric radome element over the planar phased array antenna. As shown in FIGS. 14A-14D, in the latter embodiment and for the embodiments associated with FIGS. 1A-13 described above, the disposition of the fabric radome element 30 over the planar phased array antenna 20 begins with the fabric radome element 30 provided in a rolled-up condition on an edge of the housing 22. At this point, the loose edge of the fabric radome element 30 may be secured to a corresponding forward facing surface 2202 of the wall portion 220 of the housing 22 by peripheral fasteners 60 (see FIG. 8) and a roll-out of the fabric radome element 30 begins. The roll-out continues as shown in FIGS. 14B-14D whereupon the first radome securing elements 40 in each rolled-out portion of the fabric radome element 30 respectively engages with the corresponding ones of the second radome securing elements to center and secure the fabric radome element 30. Once the roll-out is complete, the fabric radome element 30 lies flat against the radiator portion 21 and may have peripheral portions thereof lying flat against each of the forward facing surfaces 2202 of the wall portions 220. As a final roll-out stage, some or all of the peripheral portions of the fabric radome element 30 may be secured to the forward facing surfaces 2202 by the peripheral fasteners 60.

As described above, the radome assembly 10 provides for a replacement of heavy, costly and structural radomes with a thin commercially available fabric radome that can be unfurled and rolled across or placed on and then attached to a planar phased array antenna surface with no pins or mechanical fasteners between the radome and the active antenna surface. Some of the benefits of the radome assembly 10 are elimination of a structural radome, reductions in weight, profile and transportation costs, reductions in radome element movement or thermal expansion/contraction and excellent radio frequency (RF) performance over various frequencies and scan volumes. The radome element 30 of the radome assembly 10 has a low dielectric constant, low loss tangent and low profile and thus produces low RF losses over large RF bandwidths and large scan volumes with corresponding reductions in array phase and amplitude errors.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts and equivalents of all means or step plus function elements in the claims below are intended to include any structure, material or act for performing the function in combination with other claimed elements as claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While embodiments have been described, it will be understood that those skilled in the art, both now and in the future, may make various improvements and enhancements which fall within the scope of the claims which follow. These claims should be construed to maintain the proper protection for the invention first described.

What is claimed is:

1. A low profile, low loss, wide band, wide scan volume radome assembly for an antenna, the radome assembly comprising:

a fabric radome element disposable over the antenna;

first radome securing elements entirely and securably embedded within the fabric radome element; and second radome securing elements securably embedded within the antenna and respectively engageable with the first radome securing elements to thereby secure the fabric radome element over the antenna, wherein:

the fabric radome element comprises a substrate layer and an outermost layer lying atop the substrate layer, the first radome securing elements are periodically embedded within interstitial regions defined by the outermost layer of the fabric radome element, and the second radome securing elements are periodically arrayed throughout an outermost portion of the antenna.

2. The radome assembly according to claim 1, wherein the fabric radome element is unitary and continuous.

3. The radome assembly according to claim 1, wherein:

respective facing sides of the antenna and the fabric radome element are substantially parallel, and the radome assembly further comprises a foam spacer interposable between and in abutment with the respective facing sides of the antenna and the fabric radome element.

4. The radome assembly according to claim 1, further comprising peripheral fasteners disposed to secure a periphery of the fabric radome element to a periphery of the antenna.

5. The radome assembly according to claim 1, wherein the first and second radome securing elements are magnetically attracted to one another.

6. The radome assembly according to claim 5, wherein:

the first radome securing elements comprise one of metallic or magnetic members, and the second radome securing elements comprise the other one of metallic or magnetic members.

7. The radome assembly according to claim 1, wherein the first and second radome securing elements are mechanically fastenable to one another.

8. A method of radome provision for an antenna, the method comprising:

securably embedding respective entireties of first radome securing elements within a fabric radome element;

securably embedding second radome securing elements within the antenna; and disposing the fabric radome element over the antenna such that the first and second radome securing elements respectively engage to thereby secure the fabric radome element over the antenna, wherein the disposing comprises:

placing the fabric radome element in rolled-up form on a side of the antenna;

un-rolling the fabric radome element over the antenna from the side to an opposite side such that corresponding ones of the first and second radome securing elements respectively engage.

9. The method according to claim 8, wherein the respective entireties of the first radome securing elements are securably embedded inside a periphery of the fabric radome element and the method further comprises:

securably disposing the antenna within a housing; and securing the periphery of the fabric radome element to the housing.

10. A method of radome provision for an antenna, the method comprising:

securably embedding respective entireties of first radome securing elements within a fabric radome element;

securably embedding second radome securing elements within the antenna; and disposing the fabric radome element over the antenna such that the first and second radome securing elements respectively engage to thereby secure the fabric radome element over the antenna, wherein the method further comprises:

pulling the fabric radome element away from the antenna to respectively disengage first corresponding ones of the first and second radome securing elements; and continuing to pull the fabric radome element away from the antenna to respectively disengage second corresponding ones of the first and second radome securing elements adjacent to the first corresponding ones of the first and second radome securing elements.

* * * * *